United States Patent [19]

Wallace et al.

[11] Patent Number: 4,703,689

[45] Date of Patent: Nov. 3, 1987

[54] TWO LEVER PRINT ACTUATOR WITH ALIGNED PIVOTS AND ENERGY TRANSFER SURFACES

[75] Inventors: Joseph E. Wallace, Charlotte, N.C.; Han C. Wang, Chappaqua, N.Y.

[73] Assignee: International Business Machines Corporation, Armonk, N.Y.

[21] Appl. No.: 778,632

[22] Filed: Sep. 20, 1985

[51] Int. Cl.[4] ..... B41J 9/38; B41J 9/10

[52] U.S. Cl. ..... 101/93.29; 101/93.33; 101/93.48; 400/157.2

[58] Field of Search ..... 101/93.28, 93.29, 93.32, 101/93.33, 93.34, 93.48; 400/157.1, 157.2

[56] References Cited

U.S. PATENT DOCUMENTS

| | | | |
|---|---|---|---|
| 3,164,085 | 1/1965 | Hawkins | 101/93.33 |
| 3,266,419 | 8/1966 | Erpel et al. | 400/157.2 |
| 3,593,657 | 7/1971 | Guzak, Jr. | 101/93.33 |
| 3,630,142 | 12/1971 | Fulks et al. | 101/93.33 |
| 3,643,594 | 2/1972 | Pipitone | 101/93.33 |
| 3,919,933 | 11/1975 | Potter | 101/93.32 |
| 3,924,725 | 12/1975 | Kuhn et al. | 101/93.33 |
| 4,269,117 | 5/1981 | Lee et al. | 101/93.48 |
| 4,442,770 | 4/1984 | Dozier | 101/93.32 |

FOREIGN PATENT DOCUMENTS

| | | | |
|---|---|---|---|
| 55-79183 | 6/1980 | Japan | 101/93.34 |
| 58-136469 | 8/1983 | Japan | 101/93.29 |

OTHER PUBLICATIONS

H. Lee et al; "Two-Piece Hammer"; *IBM Technical Disclosure Bulletin;* vol. 27, No. 4A, pp. 2090-2092; Sep. 1984.

*Primary Examiner*—Edgar S. Burr
*Assistant Examiner*—David A. Wiecking
*Attorney, Agent, or Firm*—Carl C. Kling

[57] ABSTRACT

A two-lever electromagnetic print actuator having a pivoted bellcrank armature and an end-pivoted print hammer is urged to free-flight by energy transfer at an energy transfer contact surface. The armature pivot, print hammer pivot and energy transfer surface are aligned in sequence and substantially coplanar. This converts input energy to optimum print velocity with minimum wear. In operation, energizing a coil attracts the armature to the stator, imparting energy to an energy transfer surface on an energy transfer armature leg. The energy transfer surface moves in an arc, delivering energy to a related energy transfer surface on the print hammer. The print hammer goes into pivoted free-flight when the armature strikes a stop pad. There is mimimum sliding, and thus minimum wear, between the energy transfer surfaces of the print hammer and armature as they both move in arcs of similarly convex circles which remain tangent at their contact point. The two-lever print actuator provides a low mass print hammer with a short contact time; the hammer moves at a substantially higher velocity than the armature at the pole face due to the optimized lever length ratios.

3 Claims, 8 Drawing Figures

TWO LEVER PRINT ACTUATOR WITH ALIGNED PIVOTS AND ENERGY TRANSFER SURFACES

BACKGROUND OF THE INVENTION

1. Field of the Invention

This invention relates to a print actuator assembly, and more particularly relates to a print actuator assembly having, for each print position, and end-pivoted lever print hammer and a pivoted bellcrank armature which urges the hammer to free flight by energy transfer at an energy transfer contact surface, the armature pivot, print hammer pivot and energy transfer surface being aligned in sequence, coplanar and dimensionally interrelated for effective operation and minimal wear.

2. Description of the Prior Art

A great variety of print actuators have been described in the literature, and many print actuators have been deployed in great numbers in a wide variety of computer printers. These print actuators must in general be small enough to be replicated for each print position in multiactuator printers, or to allow space for other mechanisms in single actuator printers. The actuator, particularly if replicated, must be inexpensive and trouble free, while maintaining tolerances sufficiently close to nominal to provide good print quality. Speed is required to accomplish printing without smudging. The usual solution is to maintain very high mechanical and electrical standards, and to drive the electromagnetic coils with very high power pulses of very short duration. These high power pulses result in a great deal of heat, concentrated on very small coil wires which are crowded into a small volume. This is very wasteful in energy, giving low print energy versus input energy efficiencies with the majority of the input energy being dissipated as heat loss. The need for an inexpensive, trouble free, effective print actuator persists, particularly for printers at the lower end of the product cost spectrum.

The following patents and publications are repesentative of the prior art:

U.S. Pat. No. 3,164,085, Hawkins, MECHANICAL LINKAGES TO ELECTRO-MAGNETS AND SOLENOIDS CONTROLLING PRINT HAMMER MECHANISMS, Jan. 5, 1965. shows a rocking lever two piece print hammer, with hammer pivot in line with the energy transfer surface and armature pivot, but not with the hammer pivot between armature pivot and energy transfer surface. This relationship, while permitting energy transfer from armature to hammer with a minimum of sliding movement, results in a bellcrank configuration of the hammer. Hawkins shows a double rocker arrangement of bell crank armature and bell crank hammer which permits the point of contact 7 in Hawkins' FIG. 2 to move along a line intersecting the pivot of the two bell cranks. This hammer configuration differs from the simple lever print hammer in that it has greater inherent mass and inherently inferior flight dynamics due to lesser power-to-velocity advantage, suffers greater damping in the bellcrank and greater energy transfer to the pivot shaft.

Hawkins does not show an end pivoted lever print hammer.

U.S. Pat. No. 3,593,657, Guzak, COMBINED PRINT HAMMER MODULE AND PRINTED CIRCUIT BOARD, July 20, 1971, shows a compact construction by which a number of print hammers are operated by individual printed circuit boards.

U.S. Pat. No. 3,266,419, Erpel et al, HIGH SPEED IMPACT PRINT HAMMER ASSEMBLY WITH RESILIENT ENERGY STORING MEANS, Aug. 16, 1966.

U.S. Pat. No. 3,630,142, Fulks, ELECTROMAGNETIC DRIVE FOR PRINT HAMMERS, Dec. 28, 1971, shows a multiple print hammer assembly in which an armature operates the linear transducer serving as an impactor.

U.S. Pat. No. 3,643,594, Pipitone, PRINT HAMMER FOR HIGH SPEED PRINTER, Feb. 22, 1972, shows an armature and print hammer suspended on a common pivot.

U.S. Pat. No. 3,919,933, Potter, HIGH SPEED PRINTER, Nov. 18, 1975, shows a multiple actuator assembly using mirror image sets of three-piece pushrod print actuators.

U.S. Pat. No. 3,924,725, Kuhn et al, DUEL ARRAY DISC PRINTER, Dec. 9, 1975, shows a disc printer in which a first alphameric set is on a first half of the disc and second alphameric set is on the second half of the disc, normally, lower case half and upper case half. The print hammer is shiftable relative to the print position from a lower case position to an upper case position.

U.S. Pat. No. 4,269,117, Lee et al, ELECTROMAGNETIC PRINT HAMMER, May 26, 1981, shows a one-piece whipping hammer in which the hammer of the armature is flexible.

U.S. Pat. No. 4,442,770, Dozier, PUSHROD FOR HIGH SPEED, Apr. 17, 1984, shows an improved pushrod, for an impact printer, where the pushrod wire has a soft tip at each end, using a special configuration so that the molding of the impact buttons does not require adhesives or staking.

JA Pat. No. 55-79183, Oota, PRINTING HAMMER, June 14, 1980, shows a two-piece print hammer built according to a special formular so as to provide a zero order vibrating mode of the print hammer.

JA Pat. No. 58-136469(A), PRINT MAGNET DRIVING SYSTEM, Takeda, Aug. 13, 1983, shows a two-piece print hammer in a system having a special start-up routine so that proper printing can take place from a cold start.

Lee et al, TWO-PIECE HAMMER, IBM Technical Disclosure Bulletin, Vol. 27, No. 4A, September, 1984, pp. 2090–2092; shows a two-piece armature hammer assembly, but does not align the armature pivot, the hammer pivot and the energy transfer surface.

A number of one-piece print actuators have been deployed, typified by the whipping hammer, (U.S. Pat. No. 4,269,117, Lee et al, ELECTROMAGNETIC PRINT HAMMER) in which a relatively flexible long print hammer leg and relatively large mass coil leg form an integral armature.

A number of two-piece print actuators have been deployed, in which an armature transfers energy to the print hammer directly, usually by a camming action.

A number of three-piece print actuators have been deployed, typically having a pushrod, print hammer, and armature. The pushrod transfers energy from the armature to the print hammer. The pushrod is subject to sliding friction, is subject to bending, and requires careful assembly. This in general results in a costly assembly.

The prior art does not teach nor suggest the invention, which optimizes operation and minimizes wear in a two-lever pivoted armature, pivoted print hammer, print actuator by aligning in sequence armature pivot, print hammer pivot and energy transfer surface and by controlling lever length relationships of armature and print hammer for optimum velocity advantage.

SUMMARY OF THE INVENTION

The object of the invention is to provide a high-speed two-lever print actuator which is effective and yet subject to minimum wear.

A feature of the invention is aligning armature pivot, print hammer pivot and energy transfer surface in that sequence and essentially coplanar. This minimizes sliding action of contact surfaces during energy transfer by having the energy transfer surface on the armature and print hammer follow similarly convex circumferences of epitangent circles, the radii of which are centered at armature pivot and print hammer pivot. The circles traversed by the contact surface on the armature and the print hammer remain tangent over their short travel during operation, minimizing sliding contact between armature and print hammer contact surface.

An advantage of the invention is minimization of moving parts and minimization of wear in a high speed print actuator.

Another advantage is optimum print hammer velocity due to optimum lever arm ratio of the print hammer and the armature.

Another advantage is locating the pole face inside the coil so as to achieve the maximum magnetic energy.

A specific advantage of the invention is that it uses lever print hammers identical to those used in a previously deployed three-piece print actuator, thus taking advantage of a low mass, minimal contact time print hammer which has proved itself in actual use.

Another advantage of the invention is that it does not require flexibility in the armature; it can use materials, such as soft iron, which are more effective magnetically than the more flexible irons required by certain prior art print hammers, particularly those of the one piece whipping print hammer type.

The foregoing and other objects, features and advantages of the invention will be apparent from the more particular description of the preferred embodiment of the invention, as illustrated in the accompanying drawings.

DESCRIPTION OF A PREFERRED EMBODIMENT

Figure 1:
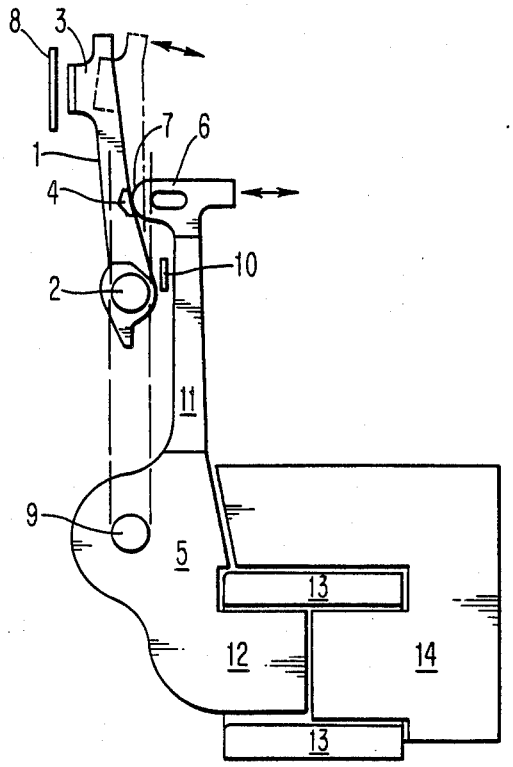
FIG. 1 is a simplified diagram of armature and print hammer according to the invention.

FIG. 1 shows basic elements and relationships in simplified fashion. Print hammer 1, pivoted on print hammer pivot shaft 2, carries print hammer impact mass 3 at its printing face at its distal end, and carries a print hammer energy transfer surface 4 at a central position towards its pivot. Print hammer energy transfer surface 4, which preferably is of increased area and increased mass, is smoothed and hardened so as to minimize destructive wear. The impact energy is developed, separately from the print hammer 1, by armature 5, which carries at its distal end 6 an energy transfer surface 7. In operation, armature 5 receives energy by energizing coil 13, causing counter-clockwise motion of armature 5 about its pivot, and imparting kinetic energy to its energy transfer surface 7. As armature energy transfer surface 7 is in intimate contact with print hammer energy transfer surface 4, the armature and print hammer will be accelerated together from the rest position. Print hammer impact mass 3 is then accelerated to the required velocity to attain good print quality when impacting print media 8. Armature 5, pivoted on armature pivot shaft 9, stops when it strikes armature stop 10, after which print hammer 1 continues in pivoted free flight during print impact and rebound. Armature 5 is a two-leg bellcrank. It includes a relatively short, relatively large mass ferromagnetic coil leg 12 which enters coil 13 for efficient energy transfer and also includes a relatively small mass, longer length transfer leg 11, which carries at its end the rounded, mass-controlled energy transfer member 6. Energy transfer member 6 has as a contact surface a convex polyurethane polymer insert 7, in the range 0.75–1.00 millimeter thickness, molded at the tip. Armature pivot shaft 9 is parallel to print hammer pivot shaft 2, both shafts lying essentially in a common plane with energy transfer surfaces 4 and 7. Print hammer energy transfer 4 and armature energy transfer 7 are in intimate contact except during the short interval of print hammer free flight and a portion of the rebound cycle.

Figure 2:
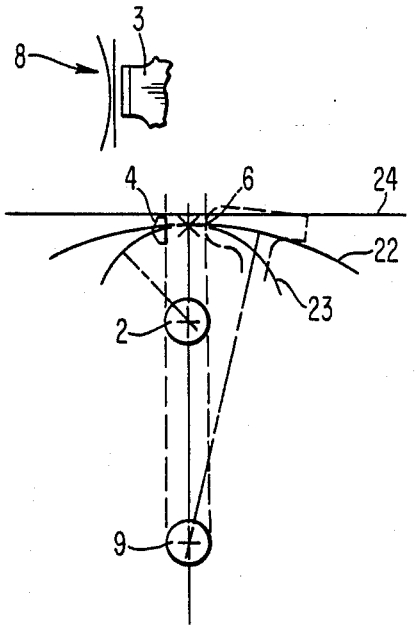
FIG. 2 is a diagram of pivot and energy transfer geometries.

FIG. 2 illustrates the operation in more detail. This relationship of energy transfer surfaces and pivots is important in minimizing wear of the energy transfer surfaces by minimizing sliding action between armature contact surface 7 and print hammer contact surface 4 during energy transfers. The geometries are such that the armature contact surface 7 and print hammer contact surface 4 are pivoted to move in similarly convex epitangent circular arcs 22 and 23 (arc 2, 4 and arc 9, 6). The epitangent circular arcs remain continuously tangent (or approximately so) at the point of contact, as the point of contact moves a very short distance along a path essentially parallel to line 24. Since the pivots and energy transfer surfaces are aligned, there is very little dynamic change in relative position of contact surfaces during the period of motion during energy transfer. The energy transfer thus is accomplished with minimal sliding action between contact surfaces of armature and print hammer, and even that sliding action is ameliorated by the curvature of the energy transfer surface 7.

The print hammer, during operation, is accelerated from rest to its nominal print impact velocity before going into free flight as a result of energy applied at its energy transfer surface 4. Print hammer 1, when accelerated by energy applied at its energy transfer surface 4, achieves pivoted free flight when the armature is topped by impact with armature stop 10 prior to print impact. This pivoted free flight travel is controlled to correspond to the desired performance. The impact mass 3 of print hammer 1 strikes print media 8 for printing. Print media 8 may be any combination of paper and inked ribbon or equivalent, which prints by impact, compressing the ribbon and paper between the type and platen.

Figure 3:
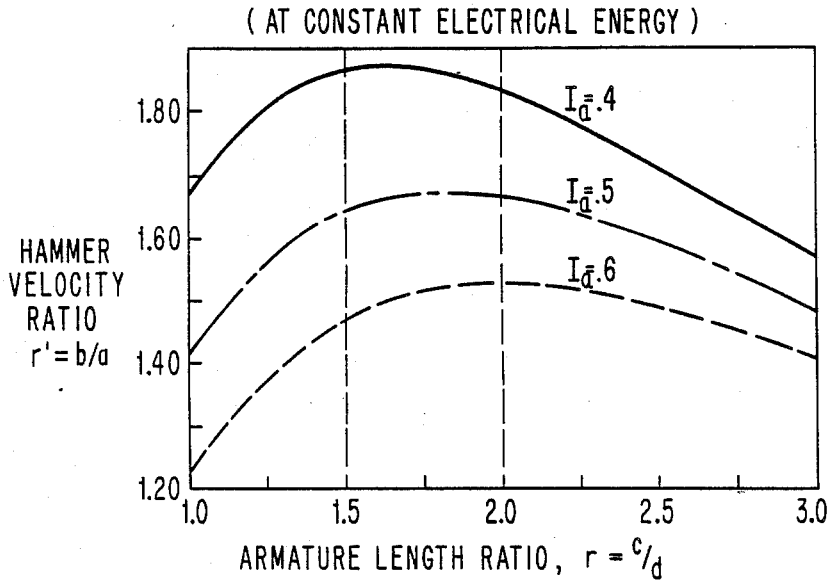
FIG. 3 is a graph of the print hammer velocity ratio as a function of the armature leg length ratio at a constant electrical input energy.
Figure 4:
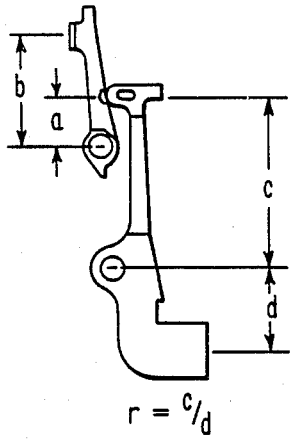
FIG. 4 is a simplified diagram of the print actuator, showing relationships of interest in the graph of FIG. 3.

FIGS. 3 and 4 describe the armature leg length relationships. The print hammer length relationship a/b is fixed in the preferred embodiment by the choice of a proven print hammer. The print hammer velocity at distance b is essentially twice that at distance a. The armature leg length relationships are selected for optimum performance. Also the armature mass in energy transfer leg c has been minimized, while still maintaining mechanical requirements, with respect to the armature mass in coil leg d for optimum performance. The armature is made of a soft magnetic material such as 1010. The armature length ratio shown in the graph (FIG. 3) is $r=c/d$. The hammer velocity ratio is the velocity gain of lever length b to lever length a, stated as $r'=b/a$. The overall inertia of the armature may be selected for wearability and other optimums, with three selections of normalized armature inertia shown in the graph as separate lines ($I_a=0.4$, $I_a=0.5$, $I_a=0.6$). As one might expect, as the armature inertia decreases, other things being equal, velocity increases. Velocity being an important parameter of impact force, it is desirable to optimize velocity. Selecting an armature length ratio (c/d) approximately 2:1 optimizes velocity over a range of armature inertias. Also reducing the hammer mass while maintaining the same a/b, c/d ratios will increase hammer velocity, decrease print energy, reduce contact time and reduce flight time.

Figure 5:
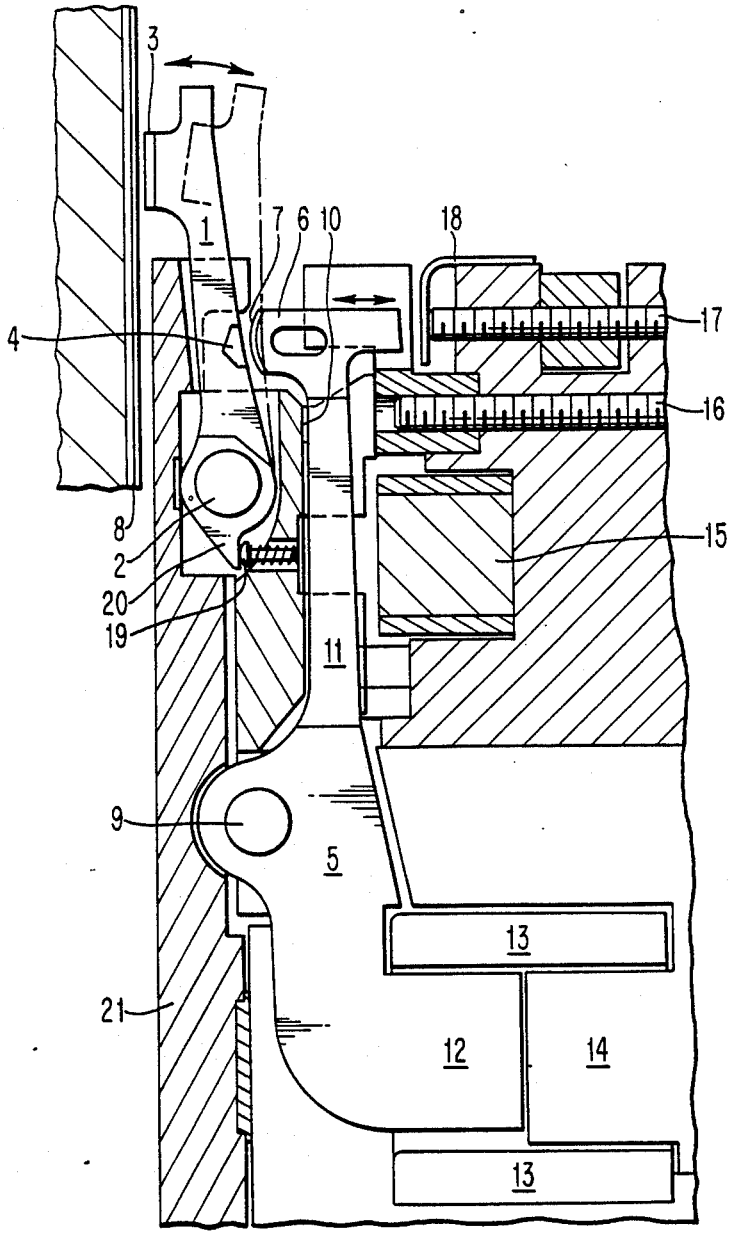
FIG. 5 is a detail diagram of the preferred embodiment.

FIG. 5 is a detailed diagram of the preferred print actuator assembly. Print hammer 1, in common with additional print hammers as required for multiposition printing (see FIG. 6), is carried on print hammer pivot shaft 2. Armature 5, similarly carried on armature pivot shaft 9, is held juxtaposed with its related print hammer by a subassembly of the print actuator assembly. The entire print actuator assembly may be formed in mirror image as shown in FIG. 7, with replicated print hammer pivot shaft and armature pivot shaft, and with alternate print hammers interspersed in well known fashion, to achieve a very compact multiactuator assembly. Components 1 to 14 have been previously described with relation to FIG. 1; components 15 to 21 complete the print actuator assembly of the preferred embodiment. There are two major subassemblies, the stator block subassembly 5 to 7, 9, 11 to 18 and the locating plate subassembly 1 to 4, 10, 19 to 21 which are brought together by screws (not shown) as the print actuator assembly means. Armature 5 is held in the rest position by permanent magnet 15. The magnetic force is maximum at the rest position and minimal at the instant of print impact because distances are greatest at that instant. Armature guide assembly screw 16, armature backstop adjustment screw 17 and armature backstop 18 perform their named functions. The backstop 18 is of a material such as polyurethane. Print hammer return spring 19, which rests against extension 20 of the print hammer 1, provides restoring energy to the print hammer to return it after print impact. This holds the print hammer against the armature energy transfer surface 7 in the rest position. Additional restoring energy is provided through rebound after print impact.

In FIG. 5, note that pivot shaft 2 and 9, while still essentially coplanar with energy transfer surface 4, do not have their centers precisely aligned with the contact surface of the energy transfer surface. Tradeoffs in manufacturability may require slight modifications from the optimum.

Pring hammer pivot shaft 2 is mounted in a channel in locating plate 21; the axis of print hammer pivot shaft 2 defines a print hammer center of rotational travel. Each print hammer 1, having an impact face end 3 and a pivoted end 20, is mounted on the print hammer pivot shaft 2, at its pivoted end, in a suitable relief in locating plate 21. This relief may be closely configured so as to hold the print hammer against lateral movement on print hammer pivot shaft 2. Similarly, armature pivot shaft 9 is mounted against plate 21, with the armature closely confined in cutaways to prevent lateral movement. Armature pivot shaft 9 is essentially coplanar with and parallel to print hammer pivot shaft 2.

In operation, it is very desirable to make the energy transfer to accelerate the print hammer with very little sliding contact between the armature and the print hammer; otherwise wear would occur. There is minimal sliding contact because the armature 5 and the print hammer 1 are pivoted in line with the contact surface 7, thus insuring that the pivoted members (armature 5 and print hammer 1) have minimum relative motion even though moving in circumferential arcs of differing radii. The fixed pivots being in line with the contact surface during the energy transfer limits the relative (sliding) motion. In addition, contact surface 7 is curved, permitting a slight rolling during the very small period of mutual motion of similarly convex arcs during a period passing through tangency. The period of tangency is lengthened by the rolling of the energy transfer surface 7; the two arcs may be characterized as "similarly convex and epitangent."

The armature pivot shaft 9, print hammer pivot shaft 2 and energy transfer surface 7 in this invention are all aligned substantially coplanar, which allows energy transfer from armature to print hammer without harmful sliding between the armature 5 and the print hammer 1. The length relationships of the armature and print hammer are selected for optimum performance, with the contact surface between armature and print hammer being about one half the distance from print hammer pivot to print hammer face end, and the armature energy transfer leg 11 to armature coil leg 12 length ratio being in the range 2.0, optimized for velocity across a range of inertia choices. The relationship of pivot positions and lengths of energy transfer armature leg and energy transfer surface at the hammer is such that energy transfer surfaces 4 and 7 are epitangent; that is, energy transfer surfaces of the armature and hammer move in similarly convex circular arcs, essentially tangent to the same line at the same point, during energy transfer, thus having minimum sliding contact during energy transfer. The armature leg lengths are optimized for velocity at the inertia selected.

Figure 6:
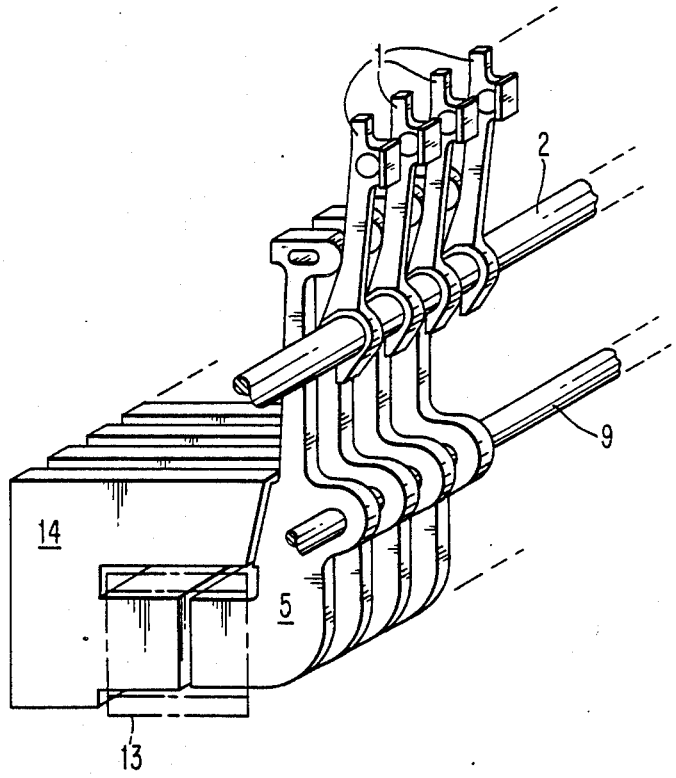
FIG. 6 is an axonometric diagram of a bank of print actuators.
Figure 7:
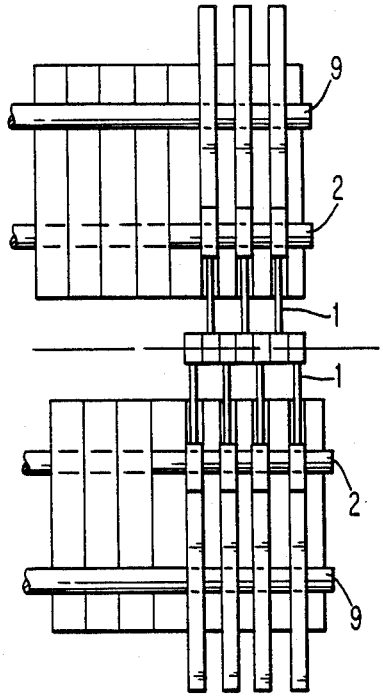
FIG. 7 and FIG. 8 together form a composite front-and-side elevation view of a double bank of print actuators.
Figure 8:
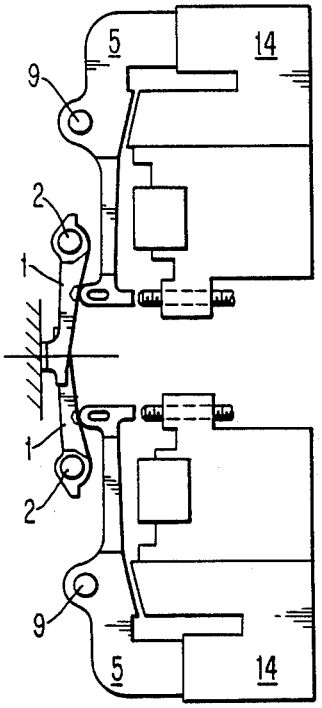

FIGS. 6, 7 and 8 show the relationships of print hammers 1 to print hammer shaft 2, armatures 5 and armature shaft 9, in a multiposition printer. As shown in FIGS. 7 and 8, print hammers may be replicated in two banks, interleaved so as to form a very compact print unit for a muliposition printer.

Thus, while the invention has been described with reference to a preferred embodiment and variations such as replication of print hammers, it will be understood by those skilled in the art that the foregoing and other changes in form and details may be made without departing from the spirit and scope of the invention.

What is claimed is:

1. A double pivot two-lever free-flight electromagnetic print actuator assembly for impact printing of print media characterized by (a) a print hammer pivot shaft (2);

(b) an end-pivoted free-flight print hammer (1), mounted on said print hammer pivot shaft (2), having a print impact mass (3) at the end opposite the pivot and a print hammer energy transfer surface (4) between said print impact mass and said pivot;

(c) an armature pivot shaft (9) at a finite distance from said print hammer pivot shaft (2);

(d) a pivoted bellcrank armature (5) made up of an electromagnetic energy receiving mass on a finite length, finite mass coil leg (12), and an armature energy transfer surface (7) on an energy transfer leg (11), said energy transfer leg having a small mass as contrasted to said finite mass, and being relatively long as contrasted to said finite length, said armature (5) being juxtaposed at rest in contact with said print hammer (1);

said armature pivot shaft (9), said print hammer pivot shaft (2), and said print hammer and armature energy transfer surfaces (4, 7) being aligned in the sequence listed and being aligned substantially coplanar during a substantially instantaneous energy transfer from said pivoted bellcrank armature to said print hammer prior to free-flight before impact with the print media, and said print hammer energy transfer surface (4) and said armature energy transfer surface (7) lying in epitangent similarly convex circular arcs during said substantially instantaneous energy transfer, thereby minimizing both rubbing and radial stray of the point of contact of said energy transfer surfaces (4,7) with respect to said epitangent similarly convex circular arcs.

2. A pivoted armature, pivoted print hammer print actuator assembly having a stator block subassembly carrying energizing coils and stators and providing a base defining a rest position adjacent to a print impact position, and having a locating plate subassembly including a number of stops 10, one for each armature position characterized by (a) a print hammer pivot shaft (2), mounted in the locating plate subassembly, its axis defining a print hammer center of rotational travel;

(b) a plurality of pivoted free-flight print hammers (1) each having a face end and a pivot end, each having its pivoted end mounted on said print hammer pivot shaft (2) and having a print hammer energy transfer surface at a distance from its pivoted end;

(c) an armature pivot shaft (9), mounted in the stator block subassembly, parallel to said print hammer pivot shaft (2), its axis defining an armature bellcrank center of rotation;

(d) a plurality of pivoted bellcrank armatures (5), mounted on said armature pivot shaft (9), each having a high mass coil leg (12) of finite length (d) for receiving electromagnetic energy and converting it to kinetic energy of motion about the armature pivot axis, having a relatively small mass, relatively long, as contrasted to said coil leg, energy transfer leg (11) of length (c) between 1.5–2.0 said finite length (d) for transferring kinetic energy via motion about the armature pivot axis, having an armature energy transfer surface (7) and a stop surface on said energy transfer leg (11), said stop surface being located a first radial distance from the armature pivot axis, and said armature energy transfer surface 7 being located a second radial distance from the armature pivot axis, said second radial distance being greater than said first radial distance, said bellcrank armature (5) thus being free to rotate in a circle about its pivot, transferring kinetic energy to said print hammer (1) via said armature energy transfer surface (7) and said print hammer energy transfer surface (4) between limits of rest position and stop position where said armature (5) stop surface strikes the related stop (10), after which said print hammer (1) continues in rotational free flight about its pivot axis (2) until it impacts the print media;

(e) print actuator assembly means locating said print hammer pivot shaft (2) and said armature bellcrank pivot shaft (9) in juxtaposition which at rest locates said energy transfer surface (4) substantially coplanar with said print hammer pivot shaft (2) and said armature pivot shaft (9).

3. A pivoted armature, pivoted print hammer print actuator assembly according to claim 2 further characterized in that said stator block subassembly (5 to 7, 9, 11 to 18) and said locating plate subassembly (1 to 4, 10, 19 to 21) each have a plurality of locating recesses for laterally positioning said armature (5) and said print hammer (1) while allowing rotation.

* * * * *